US006637122B2

(12) United States Patent
Henry

(10) Patent No.: US 6,637,122 B2
(45) Date of Patent: Oct. 28, 2003

(54) APPARATUS AND METHOD FOR SERVICING A BOW

(76) Inventor: Donald J. Henry, P.O. Box 28, Rte. 220, New Albany, PA (US) 18833

( * ) Notice: Subject to any disclaimer, the term of this patent is extended or adjusted under 35 U.S.C. 154(b) by 49 days.

(21) Appl. No.: 10/013,976

(22) Filed: Nov. 13, 2001

(65) Prior Publication Data

US 2003/0088990 A1 May 15, 2003

(51) Int. Cl.[7] ..... F41G 1/54; G01D 21/00
(52) U.S. Cl. ..... 33/506; 33/265; 124/86
(58) Field of Search ..... 33/265, 506, 333, 33/334, 365; 124/86, 87, 88, 90

(56) References Cited

U.S. PATENT DOCUMENTS 824,525 A * 6/1906 Bonney ..... 33/333
3,055,655 A 9/1962 Chelf
4,125,944 A * 11/1978 Esposito et al. ..... 33/334
4,514,907 A * 5/1985 Saltzman ..... 33/265
4,974,576 A 12/1990 Morey et al. ..... 124/87
4,986,001 A * 1/1991 Giamattei ..... 33/265
4,993,397 A * 2/1991 Cryar et al. ..... 124/88
5,048,504 A 9/1991 Ballard ..... 124/86
5,121,736 A * 6/1992 Hawk ..... 124/86
5,983,879 A * 11/1999 Gifford ..... 124/86

* cited by examiner

*Primary Examiner*—Christopher W. Fulton
(74) *Attorney, Agent, or Firm*—John J. Elnitski, Jr.

(57) ABSTRACT

The invention relates a bow vice that permits easy leveling of the vice in a horizontal plane. The vice has a base with a plurality of securing holes and having a base pocket on a first surface; a pivoting block having an attachment member for holding an object and having a pivot pocket on a first surface; a ball bearing disposed in said base pocket and said pivot pocket and holding said pivoting block and said base apart in spaced apart relation to each other; and a plurality of pivot bolts having a first end attached to said pivoting block and a second end attached to said base, said plurality of pivot bolts configured to pivot said pivoting block with respect to said base in two horizontal directions to thereby level said pivot block.

22 Claims, 8 Drawing Sheets

APPARATUS AND METHOD FOR SERVICING A BOW

Portions of this patent application contain materials that are subject to copyright protection. The copyright owner has no objection to the facsimile reproduction by anyone of the patent document, or the patent disclosure, as it appears in the Patent and Trademark Office.

BACKGROUND OF THE INVENTION

1. Field of the Invention

The present invention relates, generally, to archery bow servicing equipment and, more particularly, to a bow vice that is easily leveled and that facilitates easy movement of the attached bow into various orientations.

2. Discussion of the Background

Archery bows often require adjustment, repair, tuning of their strings, and other servicing. During such servicing, the bow must be orientated in a variety of positions to facilitate performing the necessary servicing. A bow vice is often used to hold the archery bow when performing such servicing, which may include attaching the bow sight to the bow or adjusting the bow sight. As is well-known to archers, the bow sight typically includes a bow sight level to ensure that the bow sight is horizontally level in the bow sight plane, which is the left to right plane from the user's perspective when holding the bow for shooting. The bow sight plane is shown as 706 in FIG. 9 and arrow B indicates the directions the user would tilt the bow to level the bow in the bow sight plane. If the bow sight is not level in the bow sight plane, the arrow may veer to the left or right when the user shoots an arrow with the bow at an object that has been targeted through the bow sight.

As is well-known to those skilled in the art, the bow sight is intended to be attached to the bow in a perfectly perpendicular fashion so that regardless of the orientation of the bow, the bow sight will be perpendicular to the bow. However, due to imperfections in the manufacturing process of the bow sight, the bow, and/or the attachment mechanism, while the bow sight is often attached so that it is horizontal when the bow is vertical, it is actually extending slightly forward of the bow sight plane or extending slightly behind the bow sight plane.

FIG. 10*a* is a schematical representation of three bow sights 707, 708, and 709 with the bow vertically oriented along bow plane 705. As is shown in FIG. 10*a*, all three bow sights are horizontally level since they are perfectly aligned with the horizontal plane 710 and perpendicular to bow plane 705. Thus, each bow sight is perfectly horizontal with the bow when the bow is oriented vertically. However, as shown in FIG. 10*b* (which is a planar view looking down at the intersections of the bow sight plane 706 and the bow plane 705), bow sight 707 extends slightly forward of the bow sight plane 706 and bow sight 708 extends slightly behind the bow sight plane 706. If the user with bow sight 708 tilts the bow downward to shoot the bow, the bow sight 708 moves out of the horizontal plane 710, extending upward out of the horizontal plane 710 as shown in FIG. 10*c*. Similarly, if the user with bow sight 707 tilts the bow downward to shoot the bow, the bow sight 707 moves out of the horizontal plane 710, extending downward out of the horizontal plane 710. Only bow sight 709, which is horizontal (FIG. 10*a*) and also extending on the perpendicular bow sight plane (FIG. 10*b*), remains horizontal when tilting the bow downward. Although not shown in the figures, tilting the bow upward would produce similar results with bow sight 708 extending downward out of the horizontal plane, bow sight 707 extending upward out of the horizontal plane, and bow sight 709 remaining in the horizontal plane.

Thus, with respect to bow sights 707 and 708, when the user tilts the bow up or down (as is often the case), the bow sights will no longer be horizontal to the bow and would therefore provide the user with an inaccurate targeting mechanism. Only bow sight 709, which was been leveled in both planes, would provide an accurate targeting mechanism with the bow in any orientation. The present invention provides a convenient and easy mechanism for leveling the bow sight in both planes.

A number of different devices for holding bows are known in the prior art. For example, U.S. Pat. No. 3,055,655 to Chelf discloses a device for stringing archery bows. The device includes a pair of oppositely directed, upwardly and outwardly disposed support arms, notched at their outer ends to receive the limbs of the bow inwardly of their outer ends to hold them supported while the grip portion of the bow is depressed whereby the nock ends are sufficiently drawn together to permit easy stringing.

Likewise, U.S. Pat. No. 4,974,576 to Morey et al. is directed to an archery bow alignment device and method. More specifically, the device holds a compound bow in either a vertical orientation for positioning of the nocking point or a horizontal orientation for positioning of the arrow shelf, sights, and pulleys. These placements are performed with the use of levels, plumb bobs, and the like in conjunction with the holding device.

U.S. Pat. No. 5,344,110 to Scarpa discloses still another prior art device for holding and positioning an archery bow, which permits positioning of an archery bow relative to a pair of orthogonal axes for performing various servicing activities. The disclosed device permits the user to pivot the attached bow over a limited range from vertical by untightening and then subsequently tightening a knob. In addition, the device permits the user to pivot the clamp mount and attached bow up from the table mount a limited degree by untightening and then tightening a wing nut.

The designs of existing and conventional bow vices are deficient in that, inter alia, such designs have not permitted ease of attachment of the bow, easy movement of the bow in different planes, or easy horizontal leveling of the vice. Further, such existing and conventional bow vices do not facilitate leveling of the bow sight with the bow in various orientations.

SUMMARY OF THE INVENTION

The primary object of the present invention is to overcome the deficiencies of the prior art described above by providing a leveling vice that permits leveling of the vice in the horizontal plane.

A key objective of the present invention is to provide a vice that facilitates leveling the bow sight with the bow in various orientations.

Another key objective of the present invention is to provide a vice that is adapted to hold and easily move a bow over a three hundred and sixty (360) degree range.

Still another key object of the present invention is to provide a method of setting up a bow.

Yet another object of the present invention is to provide a vice that permits a user to work on the bow in any orientation.

Another objective of the present invention is to provide a bow vice that is easy to use and economical to manufacture.

Accordingly, one example of the present invention accomplishes the above by having a base with a plurality of securing holes and having a base pocket on a first surface; a pivoting block having an attachment member for holding an object and having a pivot pocket on a first surface; a ball bearing disposed in said base pocket and said pivot pocket and holding said pivoting block and said base apart in spaced apart relation to each other; and a plurality of pivot bolts having a first end attached to said pivoting block and a second end attached to said base, said plurality of pivot bolts configured to pivot said pivoting block with respect to said base in the horizontal plane to thereby level said pivot block.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the following description, for purposes of explanation and not limitation, specific details are set forth, such as shape, size, orientation, and interconnections of the base, leveling block, drive block, handles, attachment rod, and methods for using the example embodiment, etc. in order to provide a thorough understanding of the present invention. However, it will be apparent to one skilled in the art that the present invention may be practiced in other embodiments that depart from these specific details. Detailed descriptions of well-known machining processes, boring methods, coatings, lubricants, fastening/securing methods, and methods of assembly are omitted so as not to obscure the description of the present invention.

While the example embodiment of the present invention is described in the context of a bow vice, other applications for the present invention will be evident to those skilled in the art.

Figure 1:
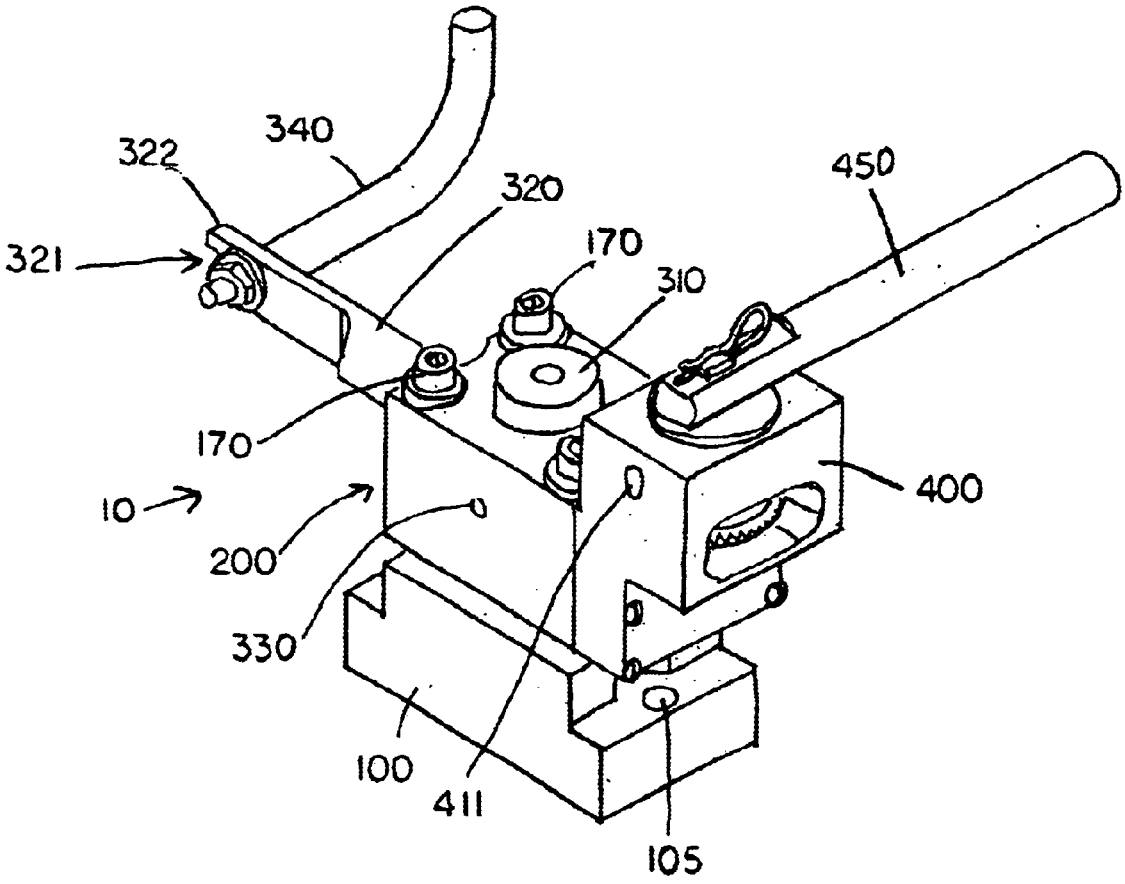
FIG. 1 is a perspective view of an example embodiment of the present invention.
Figure 2:
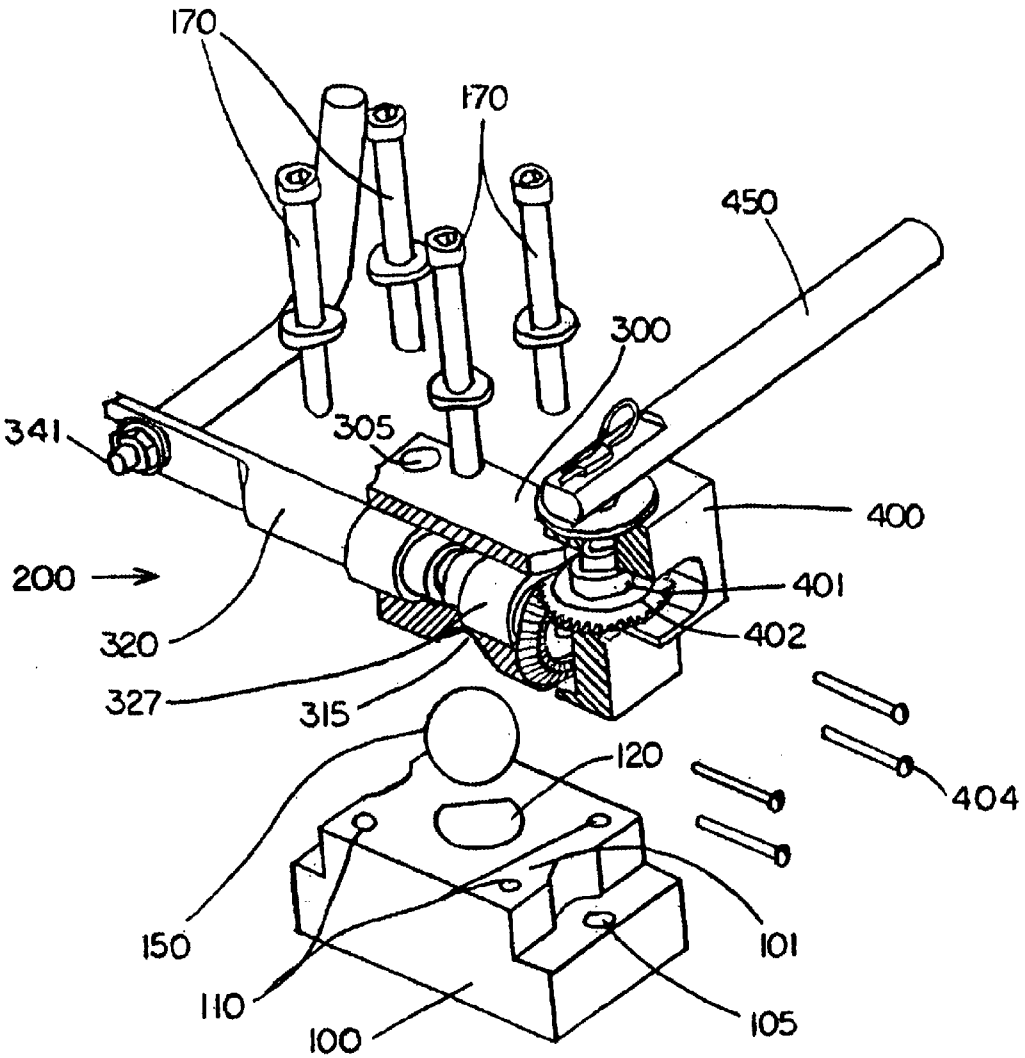
FIG. 2 is an expanded perspective view of an example embodiment of the present invention with a partial cross-sectional view of the top portion.

As shown in FIG. 1, the preferred embodiment of the present invention 10 includes a base 100 and a pivoting block, which in the present embodiment is top portion 200. Base 100 includes two mounting holes 105 (only one is visible in the figure) at opposite ends of the base 100 that permit mounting of the base to a fixed (or semi-fixed) structure such as a bench or table. As shown in FIG. 2, the base 100 also includes four threaded securing holes 110 configured to four receive leveling bolts 170, which extend from top portion 200. Base 100 also includes a pocket 120 for holding a ball bearing 150.

Referring to FIGS. 1–4, the top portion 200 includes a drive block 400, and a leveling block 300. Leveling block 300 includes four unthreaded leveling holes 305 disposed near the corners of leveling block 300 for receiving the four leveling bolts 170. In this embodiment, the leveling holes 305 are one half inch in diameter. The bottom side 301 of leveling block 300 also includes a pocket (not shown) for receiving the ball bearing 150. Pocket 120 of base 100 and pocket 315 of leveling portion 300 are sized and shaped to receive a portion the ball bearing 150. However, the depth of each pocket is less than the radius of the ball bearing 150 for reasons that will become apparent to those skilled in the art. In this embodiment, the ball bearing 150 is one and one eighth inch in diameter and each pocket 120, 315 is three eighths of an inch deep, although fashioned to mate with a ball bearing having a diameter of one and one eighth of an inch. In other words, the curvature of each pocket 120, 315 mates with the curvature of the ball bearing 150 outer surface.

Four leveling bolts 170, which in this example embodiment are five sixteenths of an inch in diameter by two and one half inches in length, extend through the four leveling holes 305 of leveling block 300 and into the threaded securing holes 110 of base 100. The head of each leveling bolt 170 is secured against a washer that is larger than the diameter of the leveling holes 305 as is well-known to those skilled in the art. When the leveling bolts 170 are extended through leveling block 301 and into base 10, the pocket 315 of leveling block 300 of top portion 200 is urged down onto the top of ball bearing 150 and the bottom portion of ball bearing 150 is pressed into the pocket 120 of the base 100. Because the radius of the ball bearing 150 is greater than the depth of the pocket 120 of the base 100 and greater than the depth of the pocket 315 of the leveling block 300 of the top portion 200, the top surface 101 of the base 100 and bottom surface 301 of the leveling block 300 of the top portion 200 are held in space apart relation from each other. In this example embodiment, both pockets 120, 315 are three eighths of an inch deep and the ball bearing 150 is one and one eighth of an inch in diameter so that the top portion 200 and base 100 are held apart approximately three eighths of an inch (one and one eighth of inch minus both three eighth of inch pockets) when the top portion 200 and base 100 are in parallel plains as shown in FIGS. 4 and 5.

Referring to FIGS. 1, 4, 6, and 7, leveling block 300 includes a bubble level 310 mounted on its upper surface substantially centered between the four leveling holes 305. An attaching member for securing the item (e.g., a bow) is coupled to the leveling block 300. In the present embodiment, the attaching member is an attachment rod 320 that extends through the leveling block 300 and includes a mounting slot 321 on its extended end 322. The portion of the attachment rod 320 that is distal from the leveling block 300 is constructed to have a substantially flat mounting surface 323 across substantially the entire diameter of the attachment rod 320. On the opposite side of the bow attachment rod 320 from the mounting surface 323 is handle surface 324, which is substantially flat and has a length that is substantially equal to the length of the mounting surface 323 and a width that is substantially equal to the width of the mounting slot 321.

The internal end 325 of attachment rod 320 (opposite extended end 322) includes a vertical gear 326, which in the present embodiment is a nylon gear that is fixedly attached to the end of bow attachment rod 320. The bow attachment rod 320 includes two bushings 327 that allow the bow attachment rod to rotate three hundred and sixty degrees (360°). In addition, bow attachment rod includes a securing groove 328, which is discussed in more detail below. The leveling block 300 is machined in a manner so that when the attachment rod 320 is assembled and the leveling block 300 is leveled, both the leveling block 300 and attachment rod 320 are leveled to a two axis, horizontal plane.

Figure 4:
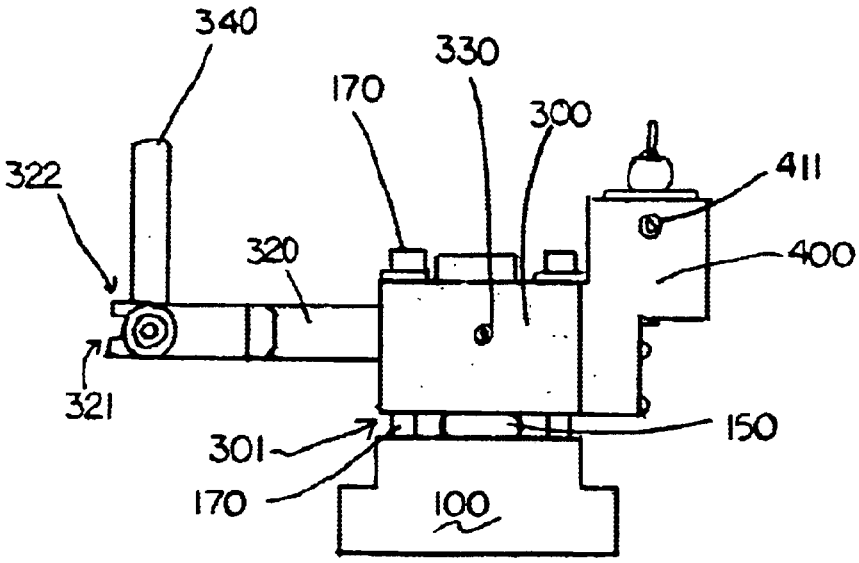
FIG. 4 is a side view of an example embodiment of the present invention.
Figure 3:
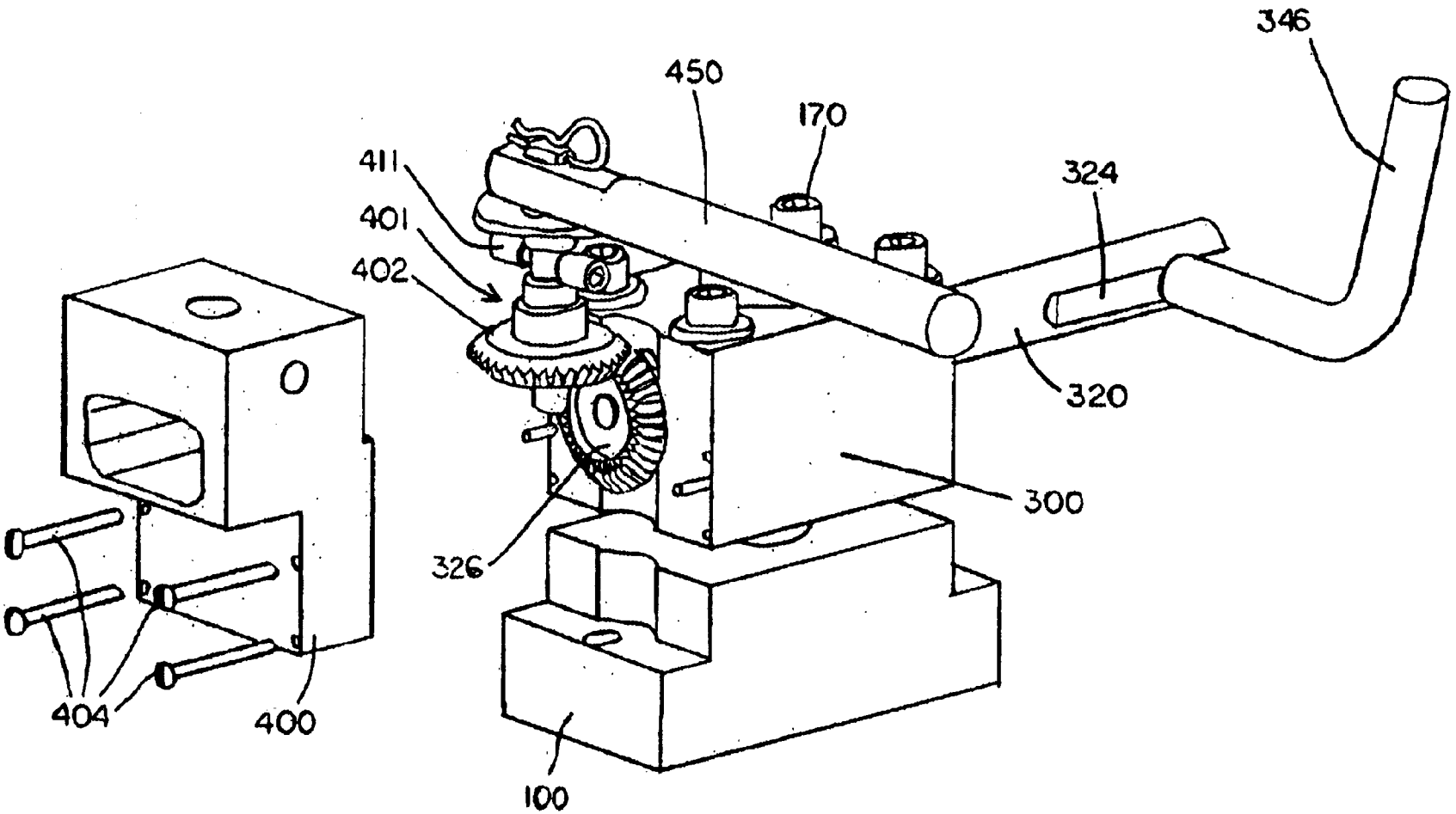
FIG. 3 is perspective view of an example embodiment of the present invention with the drive block shown in expanded representation.
Figure 5:
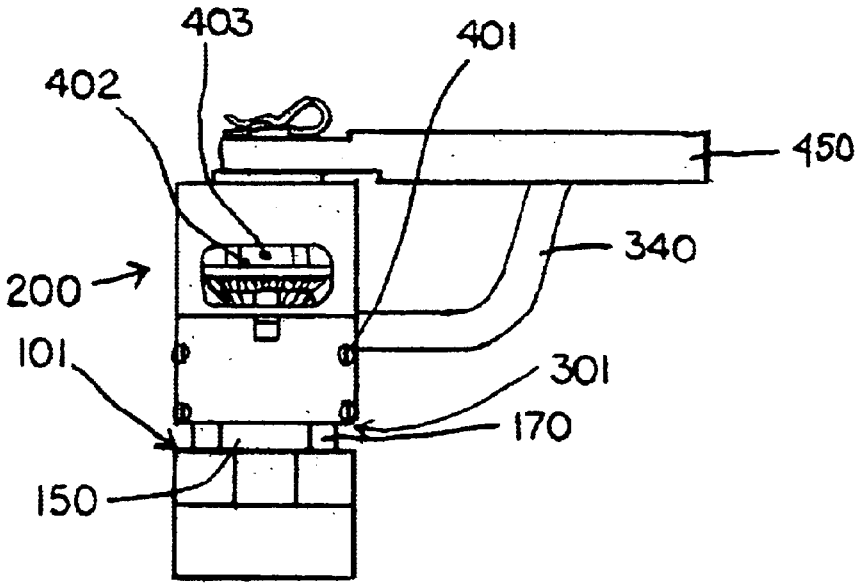
FIG. 5 is an end view of an example embodiment of the present invention.
Figure 6:
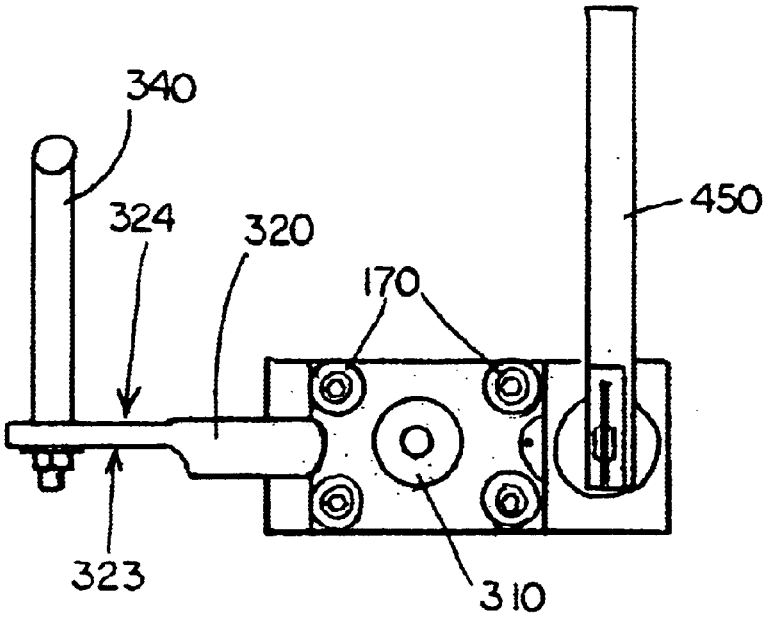
FIG. 6 is a planar view of an example embodiment of the present invention.
Figure 7:
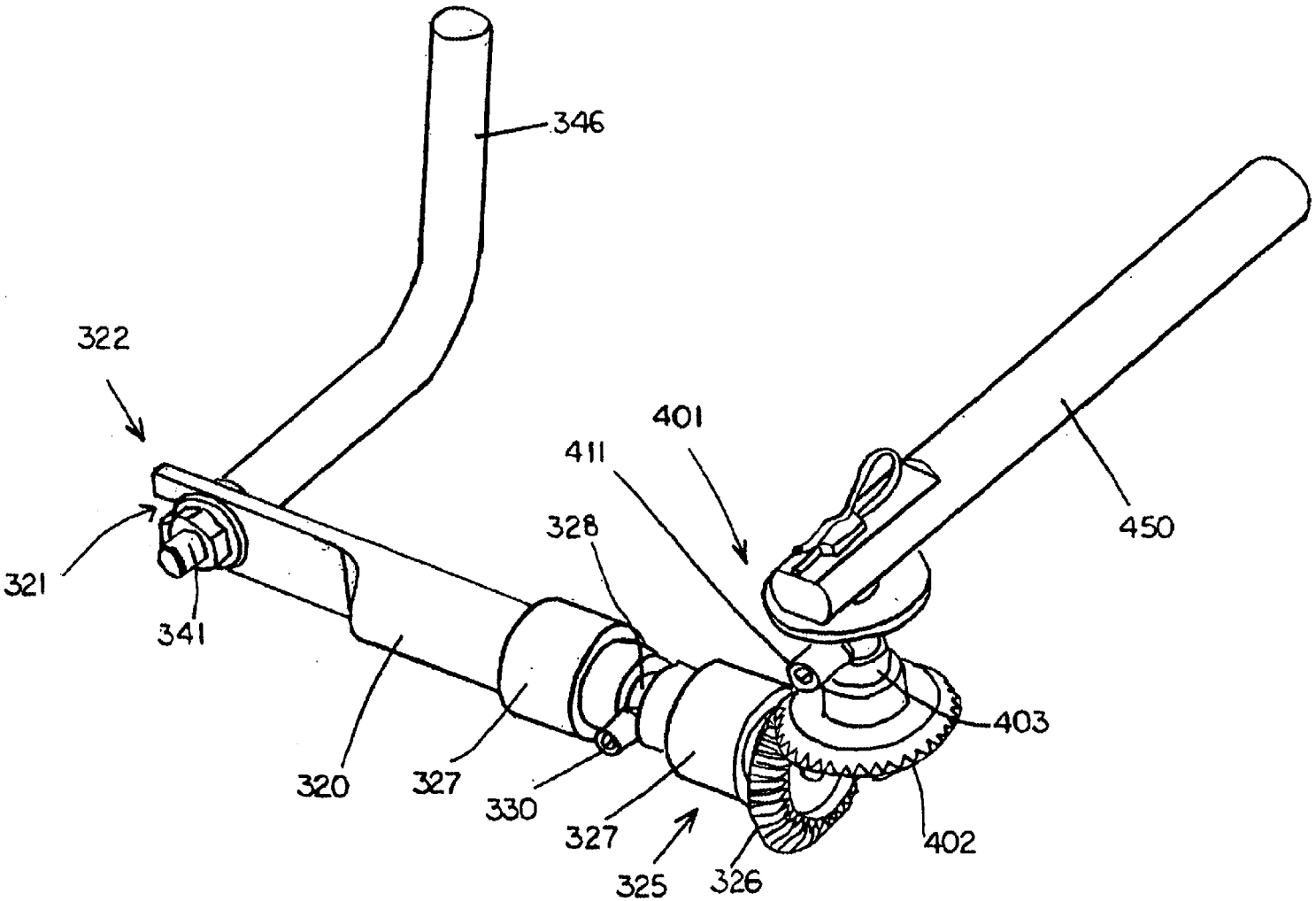
FIG. 7 is a perspective view of the attachment handle, attachment rod, positioning mechanism, and position handle of an example embodiment of the present invention.

Referring to FIGS. 3, 4, and 7, the top portion 200 includes a drive block 400 that is fixedly attached to the leveling block 300 by four mounting bolts 404. Housed inside the drive block 400 is a positioning mechanism 401, which is used to rotate and position bow attachment rod 320 through movement of the positioning handle 450. Positioning mechanism 401 includes a horizontal gear 402, which in the present example embodiment is a nylon gear that is constructed and assembled to mate with vertical gear 326. Horizontal gear 402 is mounted on the end of the gear shaft in a conventional manner. The top portion of the gear shaft extends from the top of the drive block 400 and is rectangular in shaped, but having rounded comers, so that it matches the mounting aperture in the positioning handle 450. A clip aperture in the top most portion of gear shaft 403 is sized and shaped to receive a snap clip after the positioning handle 450 is mounted to hold the positioning handle 450 in place as shown in the figures.

As is now evident to those skilled in the art, movement of the positioning handle 450 will be translated, through movement of the positioning mechanism 401 (gear shaft, horizontal gear 402, and vertical 326) into rotation of attachment rod 320. Once the user has positioned the bow in the desired position, the user may tighten rod securing screw 330, which prevents further movement of the attachment rod 320. In addition, two adjustable tension screws 411, 412, which are designed to contact a groove on the gear shaft 403, may be tightened or loosened to increase or decrease the tension on the gear shaft, thereby making it more difficult or easier to move the positioning handle 450 and/or rotate the bow attachment rod 320. By adjusting the tension screws 411, 412, the user can adjust the resistance to movement of the attachment rod 320 to any desired level. When performing servicing that requires frequent changes in orientation of the bow, it is preferred to adjust the tension screw(s) 411 and/or 412 to a level of resistance to movement that prevents unintentional movement of the attachment rod 320 and the attached bow, but that permits the attachment rod 320 to rotated through the intentional application of force to the positioning handle 450.

Leveling the Vice

As discussed, the vice must be attached to a fixed or semi-fixed object such as a workbench, which is accomplished by bolting the vice 10 to the object with the bolts extending through mounting holes 105.

Once the vice 10 is mounted, the pivoting block, which is top portion 200 in this example embodiment, must be leveled. This is accomplished by adjusting the leveling bolts 170 until the bubble in the bubble level 310 is centered thereby indicating that the top portion 200 is leveled in both horizontal axes. In other words, the user adjusts the leveling bolts 170 until the top portion 200 is level in the horizontal plane.

Adjustment of the leveling bolts requires loosening a bolt (or pair of bolts) and subsequently tightening the opposing leveling bolt 170 (or opposing pair of leveling bolts 170) to thereby tilt the top portion with respect to the base. During adjustment of the leveling bolts 170, the top portion 200 pivots over the ball bearing 150 and is free to tilt in any desired direct with respect to the base 100. The spherical shape of the ball bearing 150 permits the pocket in the leveling block 300 of the top portion 200 to slide over the ball bearing 150 in any direction (or the ball bearing 150 may spin in the pocket 120 of the base). In addition, because the diameter of the leveling holes 305 are significantly larger than the leveling bolts 170, the top portion 200 may tilt a substantial amount in any direction without the leveling bolts contacting the sides of the leveling holes 305. In essence, the leveling bolts 170 are permitted to pivot or tilt on the washers that they are mounted and do not need to remain longitudinally parallel to the sides of the leveling holes 305. Furthermore, because the combined depth of the pockets is less than the diameter of the ball bearing 150, the top portion 200 may tilt with-respect to the base 100 without contacting the base 100.

While the present invention permits easy leveling of the pivoting block, it may not always be necessary to level the pivoting block before use. When the user wishes to perform servicing during which leveling of the pivoting block would provide little or not advantage, the pivoting block need not be leveled, but simply secured to the base by tightening of the leveling bolts.

Attaching the Bow

After the top portion 200 is secured to the base 100 (and possibly after leveling the top portion), the bow is attached to the attachment rod 320 using the attachment handle 340. As shown in FIG. 7, the attachment handle 340 includes a threaded bolt portion 341 (and associated fastening nut) that is constructed to be compatible with the stabilizer hole (or insert) in most bows and is a five sixteenths (5/16)-twenty-four (24) threaded. The attachment handle 340 is screwed into the stabilizer hole on the front of the bow. After the attachment handle 340 is screwed into the stabilizer hole on the front of the bow, the bow and handle assembly are inserted into the mounting slot of the attachment rod 320, with the threaded portion 341 of the attachment handle 340 extending through the mounting slot 321 so that the bow is adjacent the mounting surface 323 of the attachment rod 320. Next, the attachment handle 340 is further rotated (tightened) to firmly secure the bow and attachment handle 340 to the attachment rod 320. The nut on the threaded bolt portion 341 of the attachment handle shown in the figures is provided to hold the attachment handle on the attachment rod 320 when the vice is not in use. The nut is not needed to fasten the bow and/or attachment handle 340 to the vice during use.

After the bow is securely fastened to the attachment rod 320, the user may rotate the bow by applying force to the bow or turning the positioning handle 450 to rotate the bow to the desired position. Once in the desired position, the user may tighten the rod securing screw 330 to prevent further movement of the bow. Alternately, the tension screws 411, 412 may be adjusted appropriately so that the resistance to movement is sufficiently high to prevent the unintentional rotation of the attachment rod 320 resulting from torque placed on the bow by the user.

Setting up the Bow

Figure 8A:
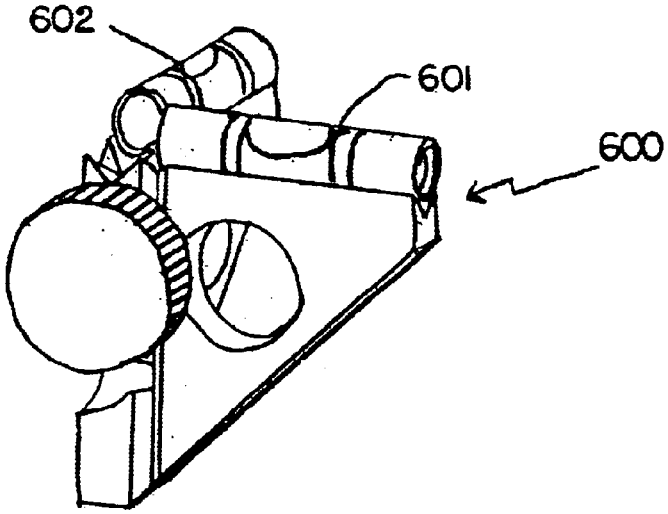
FIGS. 8*a–b* are perspective and perspective expanded views, respectively, depicting an example of a leveling device that could be used with the present invention.
Figure 8B:
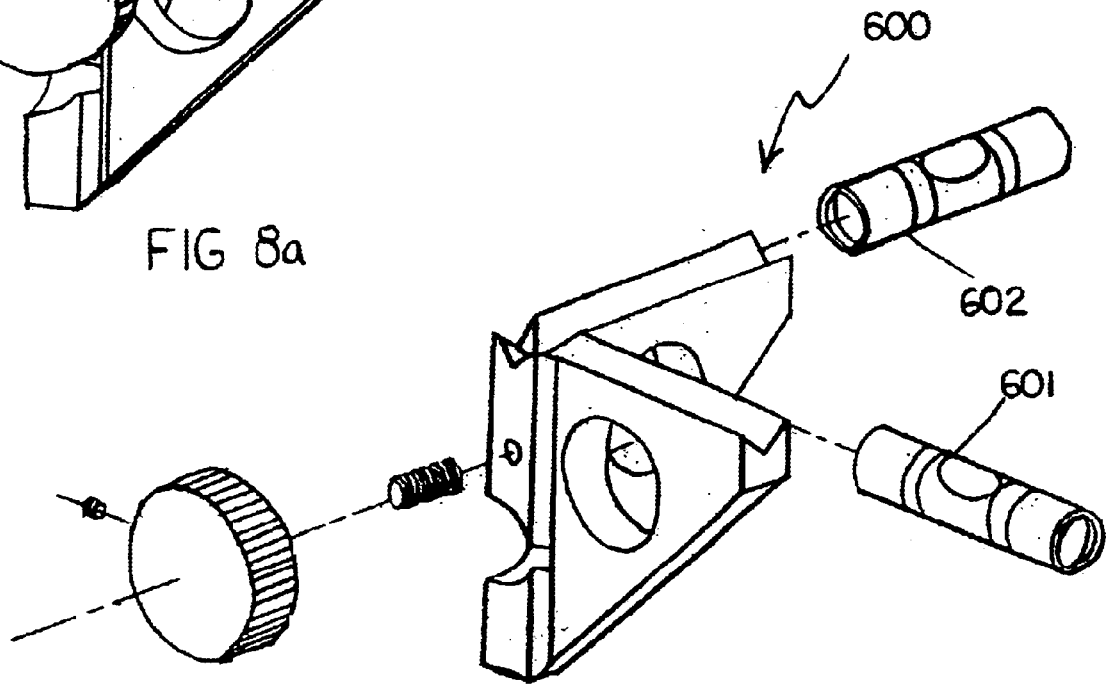
Figure 9:
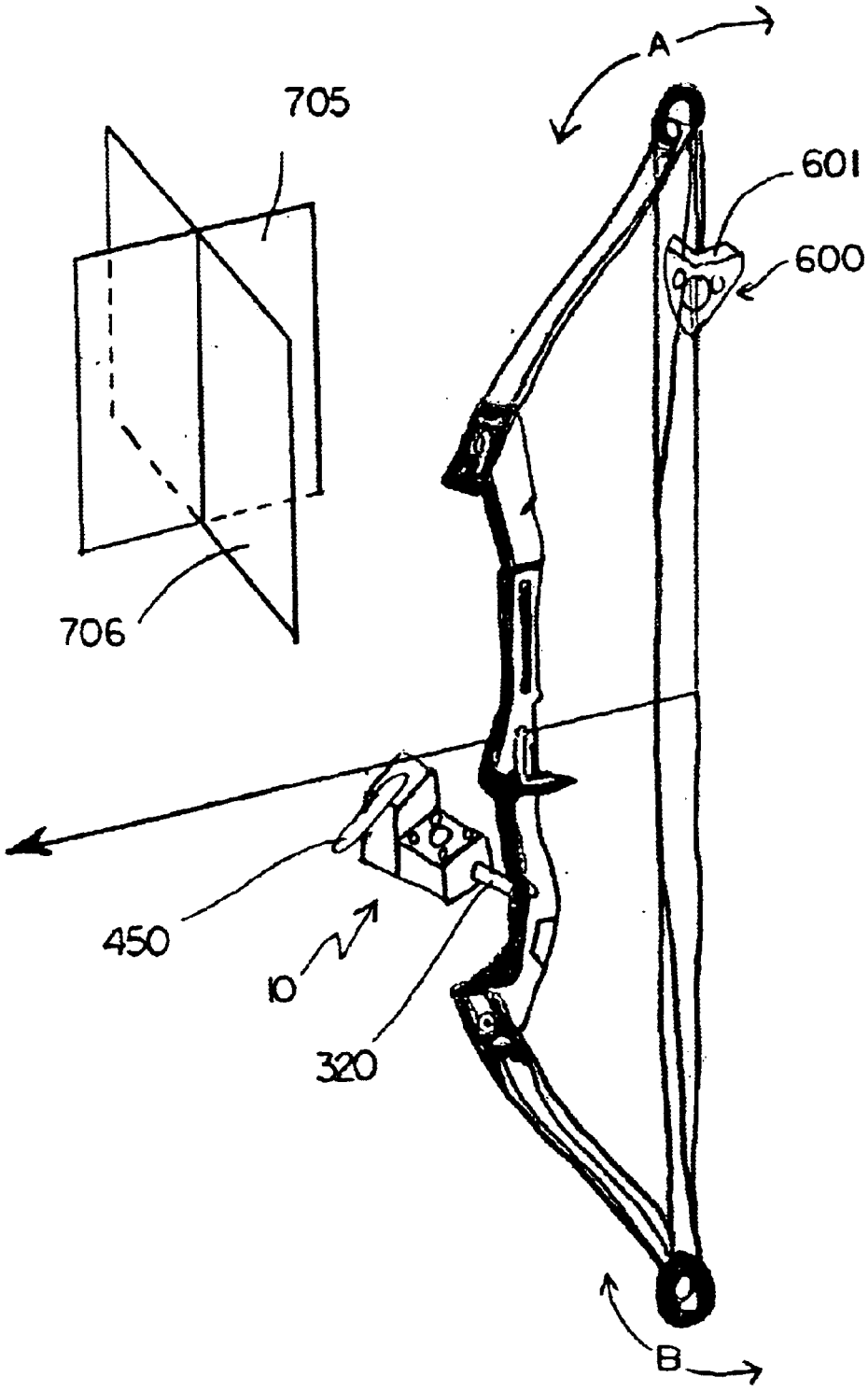
FIG. 9 is a perspective view of an example embodiment of the present invention with an attached bow.
Figure 10A:
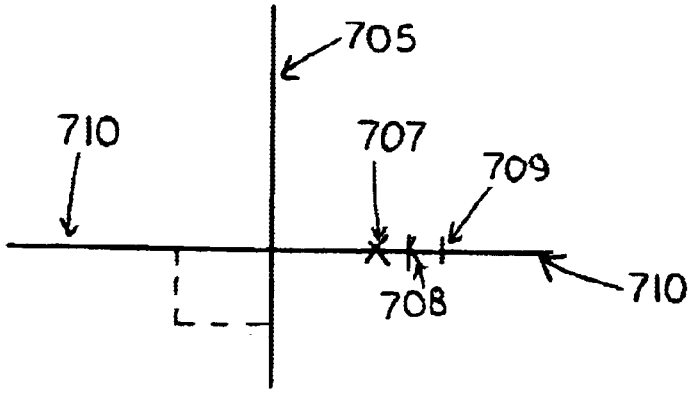
FIGS. 10*a–c* are schematical representations of three bow sights with the bow vertically oriented and tilted downward.
Figure 10B:
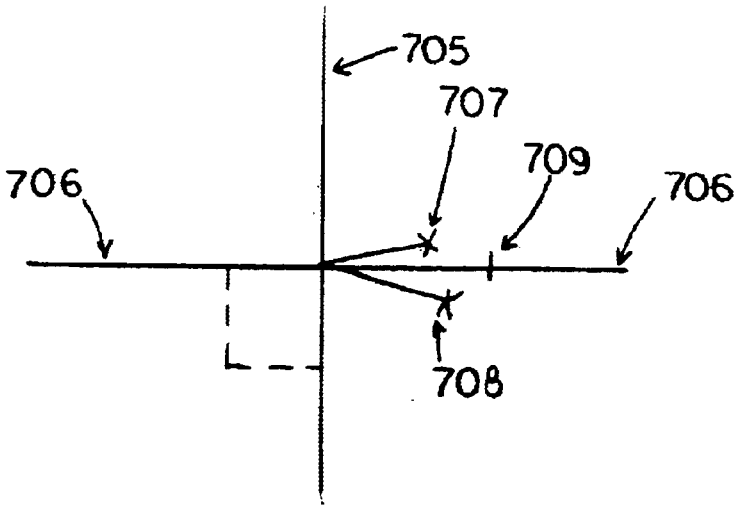
Figure 10C:
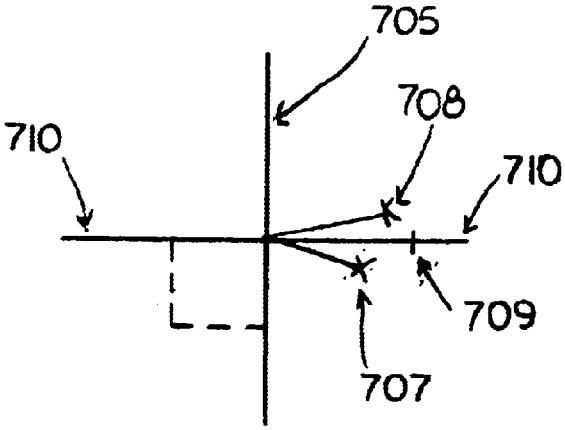

The bow vice provides an easy and convenient means for setting up the bow, which includes checking the bow sight for leveling in three axes and adjusting the bow sight if necessary. The first step in setting up the bow includes firmly securing the bow to the attachment rod 320 of the vice as previously described, which is preferably performed after the top portion 200 has been leveled. However, the present invention would work as well by attaching the bow to the vice first, and then subsequently leveling the top portion. The next step in setting up the bow comprises leveling the bow in the bow plane 705. Referring to FIG. 9, the bow plane 705 is a vertical plane that would intersect an arrow (over the entire length of the arrow) that is placed in the bow. To accomplish this task in the present example embodiment, a leveling device 600 such as the device shown in FIGS. 8*a–b* is utilized. The leveling device 600 of this example embodiment is the HTM Setup Master, which is available from HTM Precision Machining, Inc. of New Albany, Pa. As shown in FIG. 9, the leveling device 600, which includes a first 601 and second level 602 in different planes, is attached to the bow strings. To level the bow in the bow plane 705, the bow is rotated either forwards or backwards as indicated by arrow A in FIG. 9—either by moving the positioning handle 450 or applying force to the bow to rotate the attachment rod 320—until the horizontal level 601 of the leveling device 600 indicates the bow is leveled in the bow plane.

The next step in setting up the bow is leveling the bow in the bow sight plane 706, which is a vertical plane that is perpendicular to the bow plane. As is well-known to those skilled in the art, most bow sights include a bow sight level, which provides an indication to the user whether the attached bow sight is level (in the left to right directions) when the user is holding the bow in the shooting position. To level the bow in the bow sight plane 706, the bow is pivoted about the bow attachment rod 320 either clockwise or counter-clockwise as indicated by arrow B in FIG. 9 by applying force to the bow until the bow sight level indicates the bow sight is level. Thus, the bow should be secured to the bow attachment rod securely enough to reduce the likelihood of unintentional rotation, but in a manner that permits the user to pivot the bow as described.

The next step in setting up the bow is to verify the bow sight leveling with the bow tilted to different angles in the bow plane. As is well-known to those skilled in the art, the bow sight is intended to be attached to the bow riser in a perfectly perpendicular fashion so that regardless of the orientation of the bow, the bow sight will be perpendicular to the bow. However, due to imperfections in the manufacturing process of the bow sight, the bow, or in the attachment mechanism, the bow sight is often attached so that it is perpendicular to the bow only in one orientation (such as when the user is aiming the bow on a perfectly horizontal plane). In these cases, when the user tilts the bow up or down, the sight may no longer be perpendicular to the riser thus providing the user with an inaccurate targeting mechanism.

Thus, the after the bow is leveled in the bow plane and bow sight plane, the bow is rotated in the bow plane 705 (as indicated by arrow A of FIG. 9) by turning the bow positioning handle 450 (or simply applying force to the bow) to verify that the bow sight remains level, which indicates that the bow sight is perpendicular to the bow in all orientations and is in the bow sight plane as is normally desired. If the bow sight does not remain level in the bow sight plane after rotating the bow in the bow plane, the user will need to adjust the bow sight so that it becomes level in all bow orientations (or at least within a predetermined angle to horizontal). Adjusting the bow sight typically involves adjusting the bow sight attachment mechanism, which typically involves tightening or loosening screws or adding or removing shims until the bow sight is leveled.

The user may elect to level the bow sight in all orientations (over three hundred and sixty degrees (360°). However, as most bow shots take place shooting only slightly up hill or down hill, the user may elect to level the bow sight in orientations that are within thirty degrees (±30°) of the horizontal or in any other desired orientations.

While the example embodiment is as described above, an alternative embodiment of the present invention could employ more or fewer leveling bolts, such as three or five. In addition, the present invention could be constructed with the top portion being triangular in shape and using a leveling bolt at two of the three corners, with the third corner being pivotally fixed to allow the top portion to rotate in either planar direction. While the threaded securing holes in the present example are in the base, an alternative embodiment could instead have the threaded portion extending from a nut above the surface of the top portion. Alternately, instead of using leveling bolts, another means of securing the top portion to the base could be used, such as in a c-clamp type mechanism. Furthermore, the ball bearing of the above example, could be integrated into, or formed as part of, either the top portion or the base. Likewise, instead of a ball bearing, the pivoting block and base could be held apart by the leveling bolts, which would be fixedly attached (although permitting pivoting) to the pivoting block. In such an alternate embodiment, adjusting the leveling bolts would raise or lower that portion of the pivoting block.

While the method of attaching the bow to the vice in the above example uses an attachment rod working in conjunction with an attachment handle, any suitable means for securing the bow to the vice could be used. For example, in an alternate embodiment, the method and apparatus for attaching the bow to the vice disclosed in U.S. Pat. No. 5,344,110, which is hereby incorporated by reference, could be used.

In addition, the leveling vice in the present example is adapted for holding and use with bows. However, other applications might necessitate further modifications to the disclosed example that would still be within the scope of the invention. For example, the attachment rod in the present invention extends laterally in the present example embodiment, but might extend vertically in an embodiment designed for use for another application. Likewise, the present invention could be designed to attach to a vertical object, instead of a horizontal object. In addition, while the pivoting block of the present example is designed to be leveled in the horizontal plane, an alternate embodiment could be designed so that the leveling is accomplished along the longitudinal axis of the attachment rod. Alternately, a user of the above example embodiment may elect to level the vice along only one axis, such as along the longitudinal axis of the attachment rod, which would still allow setting up the bow.

While the above example for setting up the bow was described in the context of a dual cam bow, the present invention could be to setup other types of bows although the processes may use different leveling devices. In addition, although the above example for setting up the bow was described by first leveling the bow in the bow plane, in an alternate method, the bow need not be leveled in the bow plane. In this alternate method, it is sufficient to level the bow vice and the bow in the bow sight plane, and subsequently move the bow over the range of desired bow orientations to ensure that the bow is set up properly.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. A vice for holding an object, comprising:

a base having a plurality of threaded securing holes, said base having a base pocket on a first surface;

a pivoting block, said pivoting block having a pivot pocket on a first surface;

an attachment member as part of said pivoting block for holding the object, said attachment member being rotatable;

a ball bearing disposed in said base pocket and said pivot pocket and holding said pivoting block and said base in spaced apart relation to each other; and a plurality of bolts having a first end attached to said base and a second end attached to said pivoting block, said plurality of bolts configured to pivot said pivoting block with respect to said base to facilitate leveling said pivoting block.

2. The vice of claim 1, further comprising a leveling mechanism attached to said pivoting block.

3. The vice of claim 1, further comprising a positioning handle operable to rotate said attachment member.

4. The vice of claim 1, further comprising a securing member for securing the object to said attachment member.

5. The vice of claim 4, wherein said securing member includes a threaded portion adapted to mate with the object and wherein said attachment member includes an opening for receiving said threaded portion of said attachment member and said securing member is operable to secure the object to said attachment member.

6. A vice, comprising;

a base;

a pivoting portion;

a plurality of adjustable securing members securing said pivoting portion to said base and operable to pivot said pivoting portion with respect to said base; and a rotatable attachment member secured to said pivoting portion.

7. The vice of claim 6, further comprising a leveling mechanism attached to said pivoting portion.

8. The vice of claim 6, further comprising a pivoting member disposed between said base and said pivoting portion and holding said pivoting portion and said base in spaced apart relation to each other.

9. The vice of claim 6, further comprising a positioning handle operable to rotate said attachment member.

10. The vice of claim 6, wherein said pivoting portion is disposed above said base and said pivoting portion includes a rotatable rod extending from said pivoting portion.

11. The vice of claim 10, further comprising a positioning handle operable to rotate said rotatable rod.

12. The vice of claim 6, further comprising a tension adjusting mechanism operable to adjust the force necessary for rotating said attachment member.

13. A method of leveling a portion of a vice and position an object attached to said vice, said vice having a pivoting block, a base and an attachment member extending substantially horizontally from said pivoting block to hold the object, said pivoting block being positioned relative to said base, at least in part, by a plurality of adjusting members and said attachment member being rotatable for positioning the object, said method comprising the steps of:

securing said base;

maintaining said pivoting block and said base in a spaced-apart relationship from each other with a pivoting member;

adjusting at least a first of said adjusting members to level said pivoting block in a first direction; and rotating said attachment member to position the object.

14. The method of claim 13, further comprising the step of adjusting at least a second of said adjusting members to level said pivoting block in a second direction.

15. The method of claim 13, further comprising the step of providing a leveling mechanism attached to said pivoting block.

16. The method of claim 13, wherein said pivoting member is a ball bearing.

17. A method of adjusting a bow sight relative to a bow using a bow vice, the bow vice having an attachment member, said method comprising the steps of:

leveling the bow vice in a first direction;

attaching the bow to the bow vice;

positioning the bow in a first position;

leveling the bow sight;

positioning the bow in a second position; and determining whether the bow sight is level while the bow is in said second position.

18. The method of claim 17, wherein said step of positioning the bow in said second position includes rotating the attachment member of the bow vice.

19. The method of claim 17, further comprising the steps of:

providing a leveling mechanism attached to the bow vice; and leveling the bow vice in a second direction.

20. The method of claim 17, further comprising steps of:

determining the bow sight is not level while the bow is in said second position; and adjusting the bow sight relative to the bow.

21. The method of claim 17, wherein said step of leveling the bow sight includes adjusting the bow sight relative to the bow.

22. The method of claim 17, wherein said step of leveling the bow sight includes adjusting the bow relative to the bow vice.

* * * * *